United States Patent [19]

Frykhult

[11] 4,134,827

[45] Jan. 16, 1979

[54] HYDROCYCLONE SEPARATOR

[75] Inventor: Rune H. Frykhult, Johanneshov, Sweden

[73] Assignee: AB Celleco, Stockholm, Sweden

[21] Appl. No.: 780,918

[22] Filed: Mar. 24, 1977

[30] Foreign Application Priority Data

Mar. 26, 1976 [SE] Sweden ..... 7603714

[51] Int. Cl.[2] ..... B04C 5/04

[52] U.S. Cl. ..... 209/211

[58] Field of Search ..... 209/211, 144; 210/512 R; 55/459 A

[56] References Cited

U.S. PATENT DOCUMENTS

| | | | |
|---|---|---|---|
| 2,610,737 | 9/1952 | Eder | 209/211 X |
| 2,776,053 | 1/1957 | Krebs | 209/211 |
| 2,965,522 | 12/1960 | Crespin et al. | 209/211 X |
| 3,129,173 | 4/1964 | Schulze | 209/211 X |
| 3,503,503 | 3/1970 | Ramond | 209/211 |
| 3,724,674 | 4/1973 | Loison | 209/211 X |

FOREIGN PATENT DOCUMENTS

| | | | |
|---|---|---|---|
| 1078998 | 4/1960 | Fed. Rep. of Germany | 55/459 A |

*Primary Examiner*—Frank W. Lutter
*Assistant Examiner*—Ralph J. Hill
*Attorney, Agent, or Firm*—Cyrus S. Hapgood

[57] ABSTRACT

A hydrocyclone separator has a tangential inlet comprising an inlet nozzle that accepts a mixture to be separated and a diluting liquid. The inlet is at one end of the hydrocyclone and a heavy fraction outlet is at the other end. The inlet nozzle introduces the diluted mixture into the hydrocyclone with a flow component directed toward the heavy fraction outlet. The hydrocyclone has a light fraction outlet at the same end as the inlet.

3 Claims, 4 Drawing Figures

HYDROCYCLONE SEPARATOR

BACKGROUND OF THE INVENTION

Cyclone separators have many uses. A major one is in the cellulose industry for the purification of cellulose fiber suspensions. Generally, a cyclone separator system includes several stages coupled in series, with every stage comprising several cyclone separators connected in parallel, having inlet and outlet chambers in common. Such a cyclone separator system separates the original, highly diluted cellulose suspension into diluted, purified fibers, called the "light fraction", and thickened impurities, called the "heavy fraction". As modern process technology has advanced, cellulose suspension temperatures have increased, causing viscosities to decrease. With decreasing viscosities and the same number of stages, the separating power of a cyclone separator system decreases and more cellulose fibers are discarded with the heavy fraction. A high fiber concentration in the heavy fraction can also cause plugging of the final cyclone separator stage.

Many attempts have been made, some on a commerical scale, to solve problems of fiber loss and plugging. One such attempt entails supplying water under pressure to the individual cyclone separators to dilute the heavy fraction and to wash out the valuable fibers. Water is supplied tangentially near the heavy fraction outlet end of the cyclone separator, or through a channel ending at a radial distance from the wall of the cyclone separator within the heavy fraction outlet end. Another involves discharge chambers, formed like cylinders or cones and provided with a tangential inlet for diluting water, directly conneted to the heavy fraction outlet of the cyclone separator. At best these attempts have solved the plugging problems and reduced the fiber losses, but drawbacks remain. It is very important in a cyclone separator that the pressure conditions prevailing in the inlet and the outlet are correct. Since diluting water has hitherto been fed to every single separator, it has been necessary to adjust the diluting water flow with great accuracy, which is difficult using regular valves. And because a cyclone separator plant consists of several stages each having several cyclone separators arranged in parallel, the diluting water must be distributed absolutely evenly between the different units, a requirement that has proven nearly impossible to satisfy in practice. Furthermore, existing solutions create severe wear problems.

The principle of driving a cyclone separator with diluting water, supplied through a tangential inlet, while a liquid suspension is supplied through another tangential inlet is known as well, e.g. from U.S. Pat. No. 3,503,503. That patent discloses the supply of liquid suspension through a tangential inlet, arranged at right angle to the principal axis of the cyclone separator. It cannot, however, be used successfully to recover fibers from the heavy fraction flow discharging from a cyclone separator system for purification of cellulose suspension. If the objective is to purify the cellulose fibers to a great extent, and at the same time to minimize the waste flow for environmental reasons, the impurities must be collected in a final heavy fraction flow constituting a minor part of the feed flow.

SUMMARY OF THE INVENTION

It is an object of this invention to provide a hydrocyclone separator that reduces losses of the desired product without the addition of more process stages while being safe to operate.

The present invention attains this and other objects by connecting a first supply line, for carrying a mixture to be separated, and a second supply line, for carrying a diluting liquid, to an inlet nozzle to make a diluted mixture. The inlet nozzle ends in an inlet that introduces the diluted mixture tangentially into the hydrocyclone with one component of movement directly along the hydrocyclone's principal axis toward an outlet located at the end of the hydrocyclone opposite to the end at which the inlet is positioned.

Preferably the second supply line is connected to the inlet nozzle substantially at a right angle to the principal axis of the cyclone, while the first supply line is connected to the inlet nozzle at an acute angle to the second supply line, most preferably at an angle of 110° to 160°, optimally 135°, to the principal axis of the cyclone. Preferably the supply lines connect to the inlet nozzle in one plane, tangential to the cyclone. Preferably the inlet nozzle has an axial extension toward the heavy fraction outlet, between the connection with the second supply line and the inlet of the inlet nozzle to the cyclone.

BRIEF DESCRIPTION OF THE DRAWINGS

The specification, when read with the drawings, will enable a more complete understanding of the present invention. In the drawings.

DETAILED DESCRIPTION OF THE INVENTION

Figure 1:
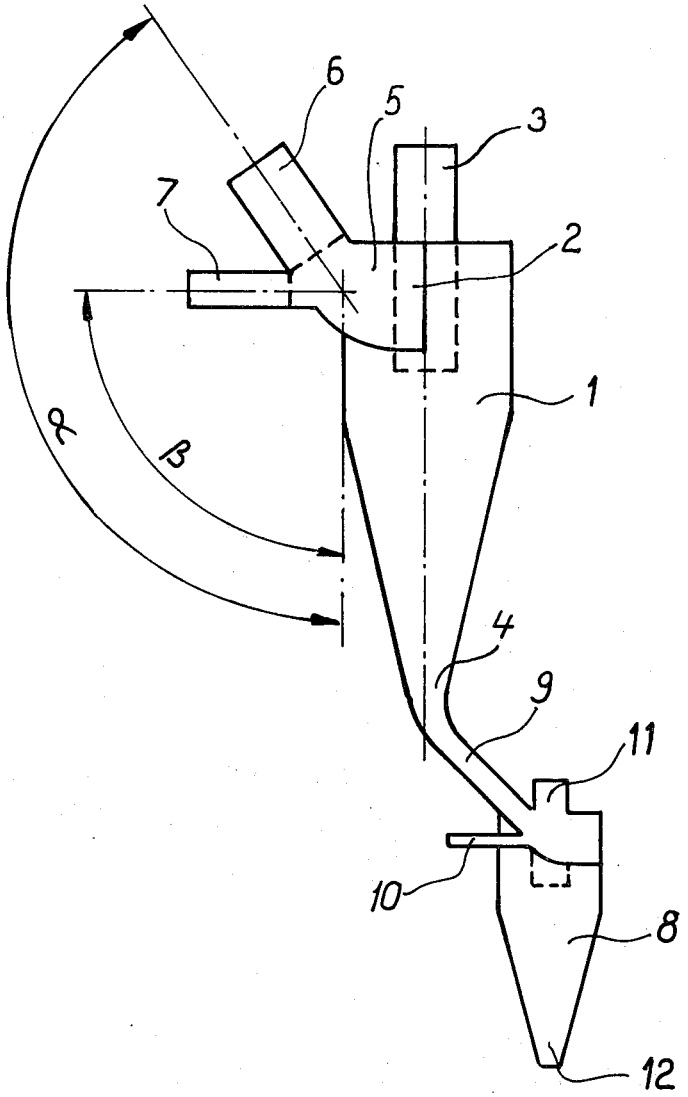
FIG. 1 is a schematic view of a hydrocyclone separator according to one embodiment of the present invention.

As shown in FIG. 1, a first hydrocyclone 1 has at one end a tangential inlet 2 and a central light fraction outlet 3 for discharging a light fraction. At its other end, it has an outlet 4 for discharging a heavy fraction. An inlet nozzle 5 connects to a first supply line 6 for the heavy fraction discharged from a cyclone plant (not shown) and to a second supply line 7 for a diluting liquid. The inlet nozzle 5 ends in the tangential inlet 2. The first supply line 6 and the principal axis of the hydrocyclone 1 form an angle that is about 135°, although angles between 110° and 160° are acceptable. The second supply line 7 connects to the inlet nozzle 5 substantially at a right angle to the principal axis of the hydrocyclone 1. Supply lines 6 and 7 connect to inlet nozzle 5 in the same plane tangential to the hydrocyclone 1 and the discharge into the hydrocyclone 1 takes place in a plane tangential to the hydrocyclone 1. The inlet nozzle 5 extends axially toward the heavy fraction outlet 4 for the portion of the nozzle between the connection point of the second supply line 7 and the tangential inlet 2. The light fraction outlet 3 extends axially to some extent beyond the inlet 2.

A second hydrocyclone 8, connected in series to the hydrocyclone 1, has a similar configuration but is smaller. Heavy fraction from the heavy fraction outlet 4 of the hydrocyclone 1 is supplied to the hydrocyclone 8 through the line 9 and diluting water is supplied through the line 10. Light fraction is discharged through the final light fraction outlet 11 and heavy fraction through the final heavy fraction outlet 12.

In the arrangement shown the flow cross-sectional areas at the connections of the respective inlet nozzles for the lines 6 and 7 and 9 and 10 are related to each other as 5.5:1.0:2.1:0.2. The relationship of the cross-sectional area of the tangential inlet 2 to the supply line 7 is 8.5:1.0.

The embodiment of the present invention shown in FIG. 1 operates as follows. Heavy fraction from the cyclone separator plant flows in through the supply line 6. Diluting water, from a white water system, is pumped under pressure through the supply line 7, thus providing the main driving force for separating cellulose fibers from impurities in hydrocyclone 1. The flows mix in the inlet nozzle 5, thus diluting the incoming heavy fraction to facilitate separation. The direction of the supply line 6, relative to the principal axis of hydrocyclone 1, and the design of the inlet nozzle 5 give the flow entering through the inlet 2 a component of movement directed axially towards the heavy fraction outlet 4, while the main component is directed at a right angle to the principal axis of the hydrocyclone 1. The heavy fraction discharged from the hydrocyclone 1 is similarly treated in the hydrocyclone 8.

The cellulose fibers discharged with the flow through the final light fraction outlet 11 are combined with the fiber flow from the light fraction outlet 3 and returned to any convenient point in the cyclone separator system. The flow from the final heavy fraction outlet 12 constitutes final waste from the cyclone separator system.

Figure 2:
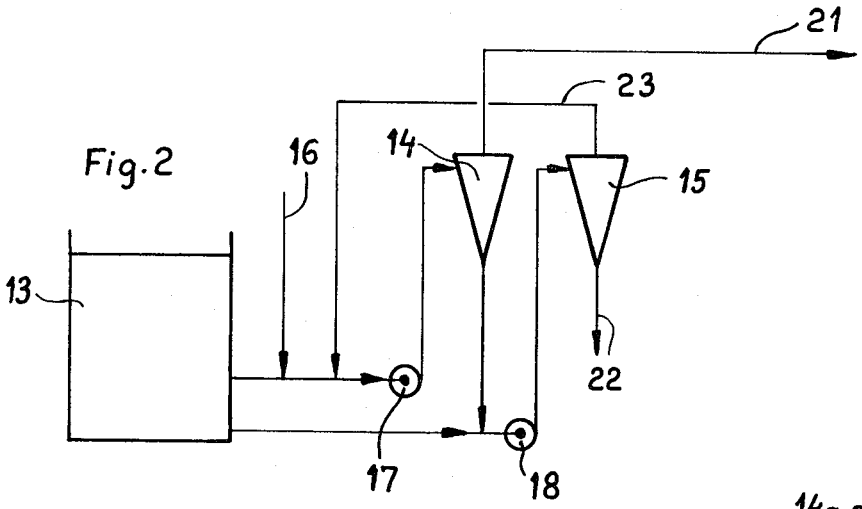
FIG. 2 is a schematic view of one prior art arrangement for purifying the final heavy fraction from a cyclone separator plant.
Figure 3:
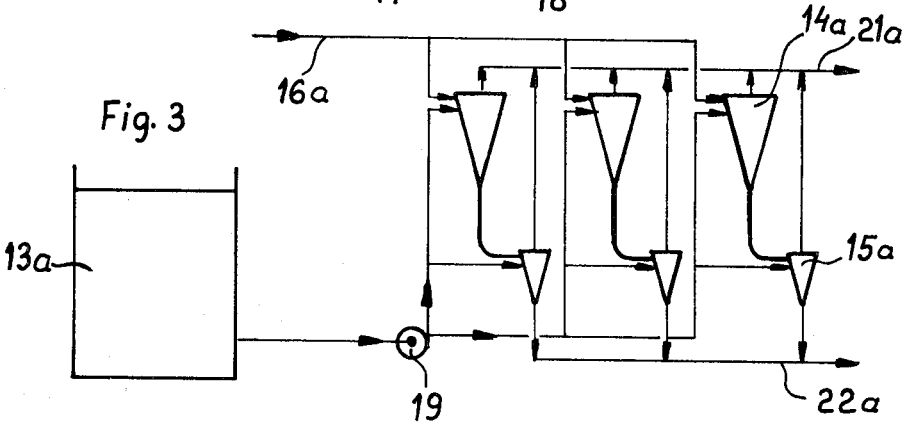
FIG. 3 is a schematic view of another prior art arrangement used for the same purpose, having tangential inlets for dilution water and for the suspension to be purified.
Figure 4:
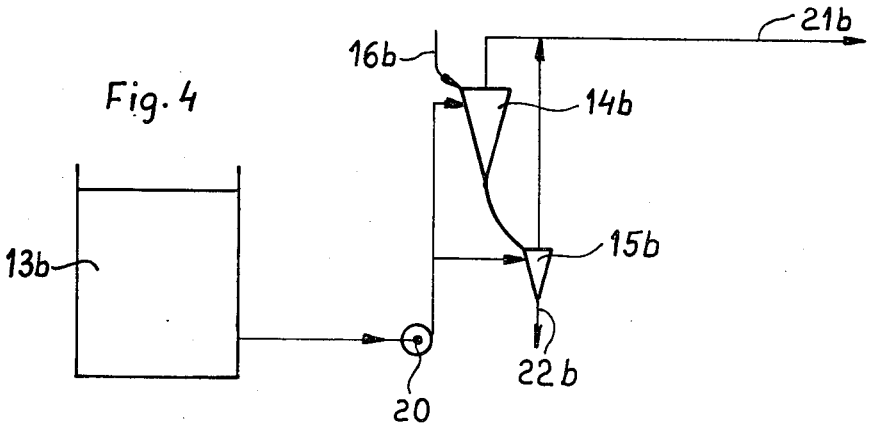
FIG. 4 is a schematic of the present invention used for the same purpose.

The advantages of the present invention are shown by data comparing the operation of the plants of FIGS. 2 to 4. FIG. 2 shows a conventional arrangement; FIG. 3 shows an arrangement comprising tangential inlets, at right angles to the hydrocyclone axis, for the fiber suspension to be purified and for the diluting water; and FIG. 4 shows an arrangement according to the present invention. In FIGS. 2–4 tanks 13, **13*a* and 13*b* contain white water for diluting the heavy fraction and driving the respective cyclone separators 14, 14*a* and 14*b*. Cyclone separators 15, 15*a* and 15*b* are coupled in series to separators 14, 14*a* and 14*b*, respectively. In FIG. 3 there are three sets in parallel of two cyclone separators coupled in series to provide a direct comparison of equipment of the same size. Lines 16, 16*a* and 16*b* supply the heavy fraction cellulose suspension from the final step of a cyclone separator plant to separators 14, 14*a* and 14*b*, respectively. Pumps 17, 18, 19 and 20 pressurize the water from tanks 13, 13*a* and 13*b*, respectively. Lines 21, 21*a* and 21*b* discharge the light fraction and lines 22, 22*a* and 22*b* discharge the heavy fraction from the respective separators. Line 23 recirculates the light fraction from the cyclone separator 15. Other features will be apparent to those skilled in the art. Data from the three systems of FIGS. 2 to 4** show the following:

I. Conventional arrangement (FIG. 2)

Losses are about 10% (by volume) or 5% (by weight)

II. Arrangement with tangential inlets at right angle (FIG. 3)

Losses are about 8% (by volume) or 4% (by weight)

III. Arrangement according to the present invention (FIG. 4)

Losses are about 3% (by volume) or 2.5% (by weight)

The present invention therefore makes it possible to recover the desired product in an efficient, simple way while reducing the losses substantially as compared to conventional equipment and to equipment having tangential inlets at right angles for the heavy fraction and diluting water.

The present invention reduces the losses significantly beyond that hitherto regarded as possible at the final step of a cyclone separator system without adding process stages. For plants incorporating the present invention at normally prevailing pressure conditions in the heavy fraction outlet and in the diluting water system, the inlet area for the suspension to be purified, and even the heavy fraction outlet, can be enlarged by a factor of 2–3 over the corresponding areas in a conventional cyclone separator of like size to greatly improve operational safety and enable use in applications in which plugging makes conventional cyclone separators too unsafe.

The present invention is not limited to arrangements for diluting and purifying heavy fractions coming from the final step of a cyclone separator plant, but can be used in any step in a cyclone separator plant.

What is claimed is:

1. A hydrocyclone separator having at one end an inlet for tangentially introducing into the separator a diluted mixture separable into two fractions and having at the other end an outlet for one of said fractions, wherein said inlet comprises an inlet nozzle connected to a first supply line for a concentrated mixture to be separated into said fractions and a second supply line for a diluting liquid, said first supply line and said second supply line being connected separately to said inlet nozzle, which inlet nozzle directs the flow into the hydrocyclone with one component of movement directed toward said outlet, said second supply line forming a substantially right angle to the principal axis of the hydrocyclone and said first supply line forming an obtuse angle to the principal axis.

2. The hydrocyclone separator recited in claim 1 wherein said obtuse angle is between 110° and 160°.

3. The hydrocyclone separator recited in claim 2 wherein said angle is substantially equal to 135°.

* * * * *